United States Patent [19]

Nineberg

[11] 4,159,171

[45] Jun. 26, 1979

[54] PORTABLE DARKROOM

[75] Inventor: Edward Nineberg, Evanston, Ill.

[73] Assignee: Consolidated International Corporation, Chicago, Ill.

[21] Appl. No.: 911,766

[22] Filed: Jun. 2, 1978

[51] Int. Cl.[2] ..... G03D 17/00

[52] U.S. Cl. ..... 354/307; 354/75; 49/41

[58] Field of Search ..... 354/75, 76, 78, 297, 354/307, 308, 309; 355/27; 49/40, 41; D25/16, 31

[56] References Cited

U.S. PATENT DOCUMENTS

| | | | |
|---|---|---|---|
| 931,502 | 8/1909 | Schureman | 49/40 |
| 953,983 | 4/1910 | Zandt | 49/40 |
| 3,893,259 | 7/1975 | Nineberg | 49/41 |
| 4,026,649 | 5/1977 | Leonhart | 355/27 |

*Primary Examiner*—L. T. Hix
*Assistant Examiner*—Alan Mathews
*Attorney, Agent, or Firm*—Emrich, Root, O'Keeffe & Lee

[57] ABSTRACT

A portable darkroom especially adapted for use in connection with the processing of X-ray films is disclosed wherein a circular enclosure, comprising an outer cylindrical housing and an inner rotatable door, for the ingress and egress of a person, is in communication with a known film processor by means of an enclosed tunnel arrangement. An opening in the outer shell when aligned with a similar opening in the rotatable door, enables a person to enter the enclosure and thereafter rotate said door to bring the opening therein into alignment with said tunnel, thus closing the opening in said outer shell, and enabling such person to pass a prepared film through said tunnel into said processor.

6 Claims, 6 Drawing Figures

PORTABLE DARKROOM

BACKGROUND OF THE INVENTION

This invention relates to portable darkrooms, and, more particularly, to portable darkrooms which are particularly well adapted for use with film processors.

It is a primary object of the present invention to afford a novel portable darkroom.

Another object of the present invention is to afford a novel portable darkroom, which is so constituted and arranged as to be well adapted for use with film processors which are external thereto.

Another object of the present invention is to afford a novel darkroom which, although it may be used in the processing of either photographic or X-ray films, is particularly well adapted for use in the processing of X-ray films.

Portable darkrooms have been heretofore known in the art. However, portable darkrooms of the type heretofore known in the art have had several inherent disadvantages, such as, for example, being large and cumbersome in size; being expensive to produce; or merely being self-contained units in which all of the film processing must be accomplished, and the like. It is an important object of the present invention to overcome such disadvantages.

Also, revolving doors of the type disclosed in, and referred to in my earlier U.S. Pat. No. 3,893,259 have been heretofore known in the art. It is another object of the present invention, while utilizing certain aspects of the construction of such revolving doors, to afford a novel darkroom, which is not disclosed or suggested by such revolving doors and constitutes an improvement thereover.

Another object of the present invention is to afford a novel darkroom of the aforementioned type which is practical and efficient in operation and which may be readily and economically produced commercially.

Other and further objects of the present invention will be apparent from the following description and claims and are illustrated in the accompanying drawings which, by way of illustration, show the preferred embodiment of the present invention and the principles thereof and which I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

Figure 1:
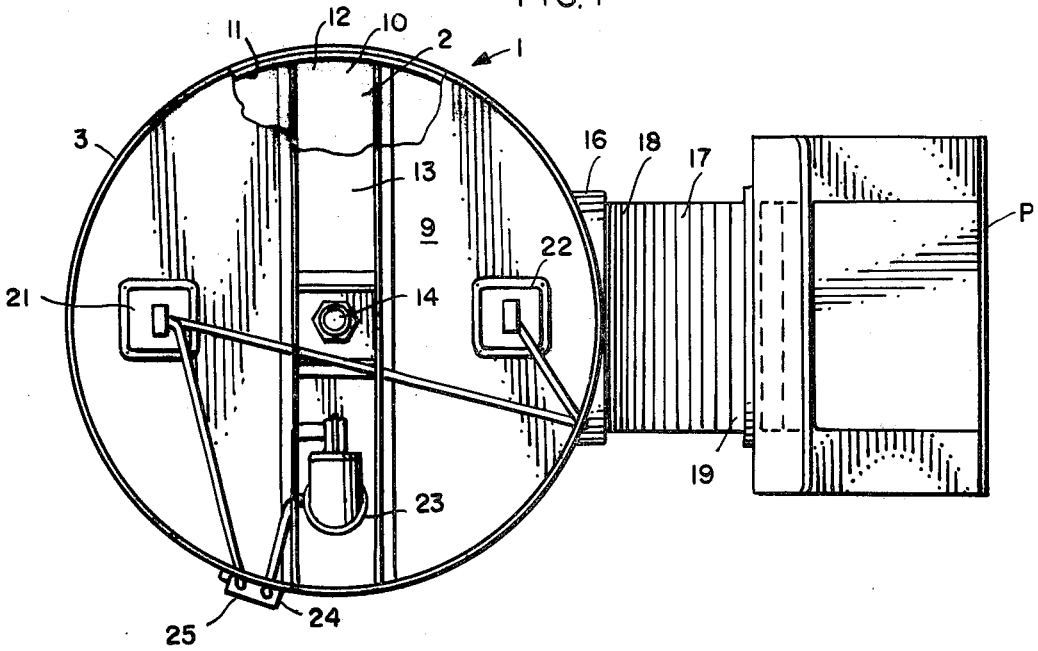
FIG. 1 is a top plan view of a portable darkroom embodying the principles of the present invention, showing the darkroom disposed in operative position relative to a film processor.

A darkroom 1, embodying the principles of the present invention, is shown in the drawings attached to a film processor P to illustrate the presently preferred embodiment of the present invention.

Figure 2:
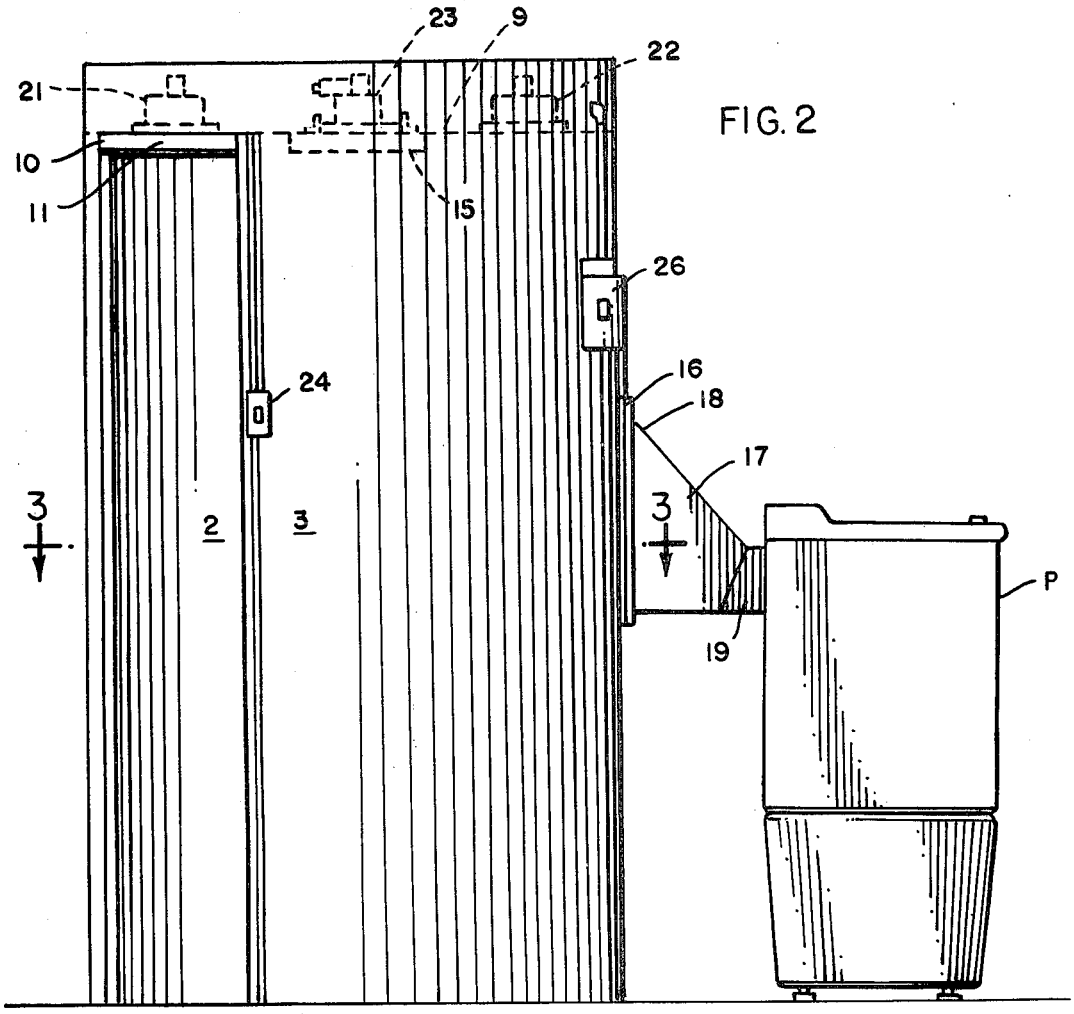
FIG. 2 is a side elevational view of the darkroom and film processor shown in FIG. 1.
Figure 3:
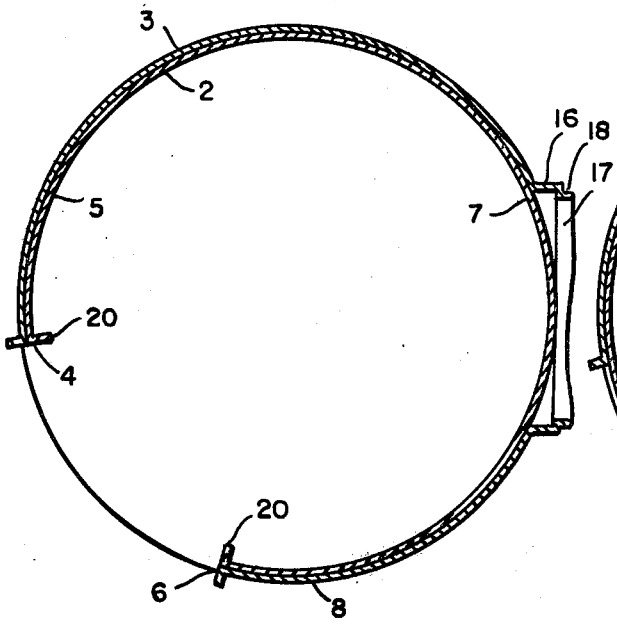
FIG. 3 is a transverse sectional view taken substantially along the line 3—3 of FIG. 2.
Figure 4:
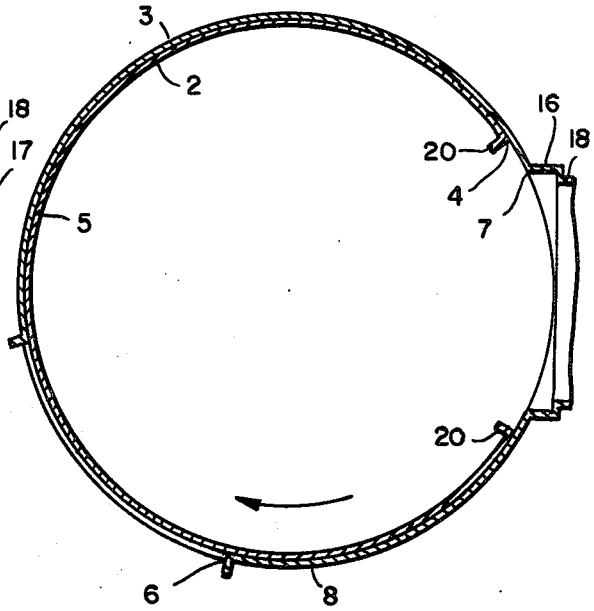
FIG. 4 is a transverse sectional view, similar to FIG. 3, but showing the door of the darkroom disposed in different operative position.

The darkroom 1 embodies, in general, an elongated, substantially cylindrical-shaped inner shell or door 2 rotatably mounted in a similarly shaped outer shell or housing 3, FIGS. 2–4. The door 2 and the housing 3 may be made of any suitable material, such as, for example, sheet steel, and are round in transverse cross section, the diameter of the door 2 being sufficiently less than the diameter of the housing 3 to insure free rotation of the door 2 around the vertical, longitudinal axis thereof within the housing 3.

The door 2 has an opening 4 in one side of the side wall 5 thereof, the opening 4 preferably extending the full length of the side wall 5. The housing 3 has two openings 6 and 7, FIGS. 3 and 4, extending through respective portions of the side wall 8 thereof. Preferably, the opening 6 extends the full length of the side wall 8, and the opening 7 is disposed inwardly from both top and bottom of the side wall 8.

The housing 3 includes a top wall 9 mounted on, and closing the upper end of the side wall 8, FIGS. 1 and 2. Similarly, the door 2 embodies a top member in the form of a ring 10, FIGS. 1 and 2, mounted on the upper end of the side wall 5 thereof. The ring 10 embodies an outer annular member 11 FIGS. 1 and 2, having such a diameter that it will fit within the side wall 5 of the door 2 with a snug fit, and a reinforcing member or cross-beam 12, FIG. 1, extending diametrically across the annular member 11. The ring 10 is disposed in the top of the side wall 5 of the door 2, in axial alignment therewith. It may be made of any suitable material such as, for example, steel, and is secured to the upper end of the side wall 5 by suitable means such as welding. Preferably, in the darkroom 1, a reinforcing member 13, similar to the cross-beam 12, is mounted on the top wall 9 of the housing 3 in diametrically extending relation thereto, FIG. 1.

In the assembled darkroom 1, the door 2 is rotatably supported in the housing 3, for rotation around the longitudinal axis thereof, by suitable means such as a bolt 14, FIG. 1, extending through and secured to the radial center portions of the top wall 9 of the housing 3 and the top member 10 of the door 2. Bearing structure 15, FIG. 2, which may be of any suitable type, such as, for example, the bearing structure shown in my aforementioned earlier U.S. Pat. No. 3,893,259, is disposed around the bolt 14, between the wall 9 and the member 10, for insuring ready rotation of the door 2 relative to the housing 3.

It is to be remembered that the diameter of the door 2 is sufficiently less than the diameter of the housing 3 to insure free rotation of the door 2 around the vertical, longitudinal axis thereof, within the housing 3. Also, it is to be noted that although the door 2 is shown in the drawings, FIGS. 3 and 4, as being disposed within the housing 3 with a relatively snug fit, this is merely by way of illustration and not by way of limitation, and, if desired, the door 2 may be spaced a greater distance inwardly from the housing 3, and suitable spacers may be disposed at the lower end portions of the door 2 and the housing 3, such as, for example, the spacers shown in my aforementioned U.S. Pat. No. 3,893,259, for preventing lateral swinging of the door 2 relative to the housing 3.

The housing 8 has a flange 16 extending around and projecting outwardly from the outer peripheral edge portion of the opening 7 therethrough, FIGS. 1–4, and a tubular member, in the form of a tunnel 17, having one end portion 18 mounted in and secured to the flange 16, projects outwardly and downwardly from the opening 7. The tunnel 17 may be made of any suitable material, such as, for example, sheet metal and may be secured to the flange 16 by any suitable means such as, for example, welding. The end portion 18 of the tunnel 17 is disposed in covering relation to the opening 7 in the housing 3, and the other end portion 19 of the tunnel 17 is disposed in outwardly projecting relation to the sidewall 8 of the housing 3 in position to be operatively connected to suitable apparatus, such as, for example, the aforementioned film processor P, FIGS. 1–2.

With this construction, the darkroom 1 may be constructed of such size that it affords a readily portable darkroom for use in conjunction with apparatus, which are well known in the art, such as the aforementioned film processor P. In the operation of the darkroom 1, it may be disposed in operative position relative to the apparatus, such as the film processor P, with the end portion 19 of the tunnel 17 connected into the inlet opening of the processor P. With the door 2 disposed in the position shown in FIG. 3, the operator, with the film to be processed, may walk through the opening 6 in the housing 8 and the opening 4 in the door 2 into the darkroom 1, and then rotate the door 2 around its longitudinal axis into the position shown in FIG. 4, wherein the opening 4 is disposed in adjacent alignment to the opening 7 in the housing 3. In this position of the door 2, the side wall 5 thereof is effective to close the opening 6 in the housing 8 and thus prevent light from entering into the darkroom 1 through the opening 6. After preparing the film which he has taken with him into the darkroom 1 for processing in the processor P, the operator may insert the film into operative position in the processor P through the tunnel 14. Thereafter, while the film is being processed in the processor P, the operator, if he so desires, may again rotate the door 2 around its longitudinal axis back into the position shown in FIG. 3, and exit the darkroom 1 through the doorway afforded by the opening 4 in the door 2 and the opening 6 in the housing 3.

Preferably, the door 2 has a suitable handle, such as, for example, inwardly projecting flanges 20, defining respective sides of the opening 4, which may be grasped by the operator for ready rotation of the door 2 in the housing 3.

Also, in the preferred form of the darkroom 1, the door 2 and the housing 3 are lined with a suitable thickness of lead, so as to afford protection to an operator working therein when the darkroom 1 is positioned in the vicinity of an X-ray machine.

In the preferred form of my novel darkroom 1, two lamps 21 and 22 and a blower 23 are mounted on the top wall 9 of the housing 3, FIGS. 1 and 2. The lamp 21 may be of a suitable type, well-known in the art, which may be illuminated during processing of film without affecting the film, and it and the blower 23 are connected through a suitable control switch 24 to a suitable source of electric power, not shown. The switch 24, shown in the drawings, is of the type which embodies a manual control 25, FIG. 1, for opening and closing the same and thereby connecting and disconnecting the lamp 21 and the blower 23 relative to the aforementioned source of power. With this construction, when the operator is going to enter the darkroom 1, he may first actuate the switch 25 to connect the lamp 21 and the blower 23 to the source of power and thus illuminate the interior of the darkroom 1 in the aforementioned manner, whih is safe for film, through the energization of the lamp 21, and provide ventilation for the darkroom 1 through the operation of the blower 23. If desired, rather than embodying a manually operated switch, such as the switch 24, the darkroom 1 may embody a switch, not shown, which is automatically actuated to open and close, when the door 2 is closed and opened, respectively, relative to the opening 6 in the housing 3.

The lamp 22 may be connected through and controlled by the processor, so that in some instances, when the processing of the film is completed, the lamp will light. Like the lamp 21, the lamp 22 is of a type, well known in the art, which can safely be illuminated during the handling and processing of film.

Figure 5:
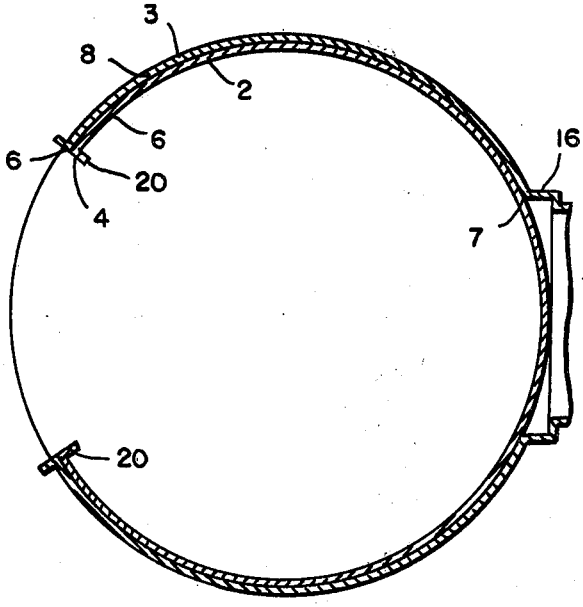
FIG. 5 is a view similar to FIG. 3, but showing a darkroom having the doorway through the outer housing thereof disposed in different position.
Figure 6:
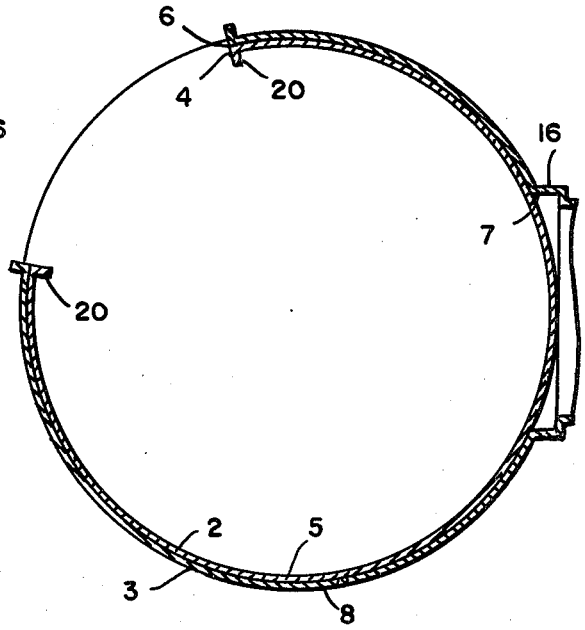
FIG. 6 is a transverse sectional view similar to FIG. 3, but showing a darkroom having the doorway through the outer housing thereof disposed in yet a different position.

In FIG. 3, the opening 6 in the housing 3 is shown disposed below the center line of the opening 7 therein at approximately a 45° angle. However, this is merely by way of illustration and not by way of limitation, and the opening 6 may be disposed in other positions, such as, for example, immediately opposite the opening 7, as shown in FIG. 5, or above the longitudinal center line of the opening 7, as shown in FIG. 6, without departing from the purview of the present invention.

From the foregoing, it will be seen that the present invention affords a novel portable darkroom.

Also, it will be seen that the present invention affords a novel portable darkroom which is particularly well adapted for use with film processors disposed exteriorly thereof.

In addition, it will be seen that the present invention affords a novel portable darkroom which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A portable darkroom for use in connection with the processing of film, comprising (a) a vertically extending outer cylindrical housing closed at the top thereof and having
  (1) a first opening through the wall thereof for ingress and egress of a person, and
  (2) a second and smaller opening through the wall of said housing spaced a predetermined distance circumferentially from said first opening, (b) a tunnel extending outwardly from said second opening, the inner end of said tunnel covering said second opening and being in communication therethrough with the interior of said housing, (c) the outer end of said tunnel being adapted to be connected to and in communication with a film processor, (d) an inner cylindrical door mounted for rotation within said housing and having an opening therethrough, (e) said opening in said door being adapted (1) to be brought into alignment with said first opening in said housing when said door is rotated to a first position thereof, and (2) to be brought into alignment with said second opening in said housing when said door is rotated to a second position thereof, (f) the relation between all of said openings being such that said door will completely close said first opening in said housing when said door is disposed in said second position thereof wherein said opening in said door is in alignment with said second opening in said housing, whereby an exposed film to be processed can be manually deposited in the film processor from the interior of said housing through said tunnel, without damaging said film.

2. A portable darkroom as defined in claim 1, wherein (a) said housing and said door are lead lined to enable said darkroom to be used in conjunction with X-ray rooms.

3. A portable darkroom as defined in claim 1, and in which (a) said door is rotatably supported from said top of said housing for rotating between said first and second positions.

4. A portable darkroom as defined in claim 1, and in which (a) said smaller opening is spaced from the top and bottom of said housing.

5. A portable darkroom as defined in claim 1, and which includes a. lamp means mounted on said housing for illuminating the interior of said housing and door with light which does not deleteriously affect film, and b. blower means for feeding ventilating air into said housing and door.

6. A portable darkroom as defined in claim 5, and which includes a. other lamp means mounted on said housing for affording a signal visible within said housing and door.

* * * * *